United States Patent [19]

Lane et al.

[11] Patent Number: 4,934,976

[45] Date of Patent: Jun. 19, 1990

[54] METHOD OF SCREEING PROJECTION TUBE INCORPORATING INTERFERENCE FILTER

[75] Inventors: Joseph E. Lane, Auburn; Kenneth Speigel, Seneca Falls, both of N.Y.

[73] Assignee: North American Philips Corporation, New York, N.Y.

[21] Appl. No.: 288,582

[22] Filed: Dec. 22, 1988

[51] Int. Cl.[5] ..... H01J 9/22

[52] U.S. Cl. ..... 445/52; 427/73

[58] Field of Search ..... 445/52; 427/73, 68

[56] References Cited

U.S. PATENT DOCUMENTS

| | | | |
|---|---|---|---|
| 2,662,829 | 12/1953 | Krause | 427/73 X |
| 2,970,930 | 2/1961 | Windsor | 427/73 |
| 4,513,024 | 4/1985 | Morita et al. | 427/73 |

*Primary Examiner*—Kenneth J. Ramsey

*Attorney, Agent, or Firm*—John C. Fox

[57] ABSTRACT

A phosphor screen for a cathode ray tube employing an interference filter for projection television is produced by temporarily sealing the face panel and funnel of the tube together, forming the screen by a settling technique, and then separating the screened panel and funnel to allow access to the panel for further processing prior to permanently sealing the panel and funnel together.

9 Claims, 2 Drawing Sheets

FIG. 1
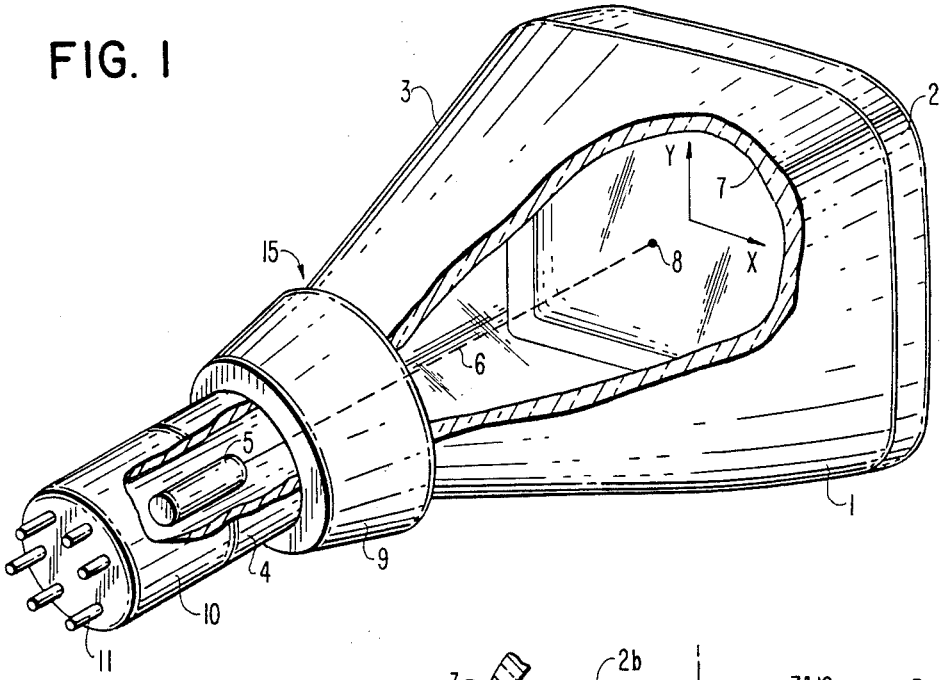
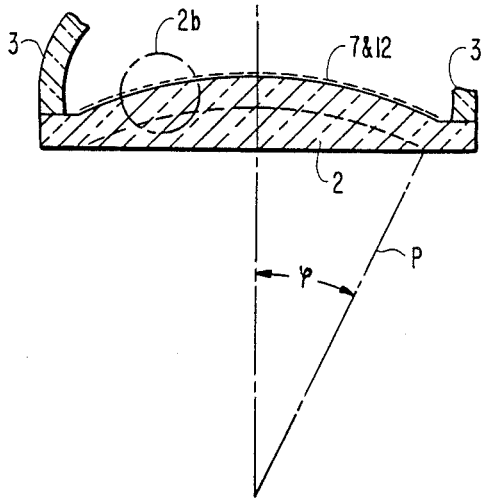
FIG. 2a
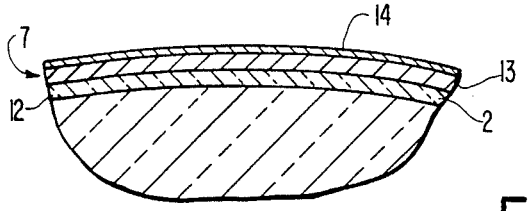
FIG. 2b

METHOD OF SCREEING PROJECTION TUBE INCORPORATING INTERFERENCE FILTER

BACKGROUND OF THE INVENTION

This invention relates to a cathode ray tube for use in projection color television, and more particularly relates to a method of forming a luminescent screen for such a tube.

Monochrome cathode ray tubes, for example, for projection television, employ a single electron gun mounted in the neck of the tube to focus a single electron beam on the luminescent display screen of the tube. A deflection yoke surrounding the neck of the tube, and associated electronic circuitry, cause the beam to scan the screen as well as to vary in intensity in response to a video signal to produce a monochrome display image.

In projection color television, three such displays, each in one of the primary colors, red, blue and green, are superimposed on a large projection screen to produce a full color display image. Because the images on the individual tube screens are not viewed directly, but are magnified and projected by a system of projection lenses, the individual cathode ray tubes are driven at higher loads than would be encountered for direct view tubes, in order to produce a full color display of acceptable brightness.

Projection tubes having interference filters designed to result in marked increases in luminous efficiency in the forward direction, as well as improved chromaticity and contrast, are described in U.S. Pat. Nos. 4,633,131, assigned to North American Philips Corporation, and 4,634,926, assigned to U.S. Philips Corporation, in which the filter is characterized as a short wave pass (SWP) filter and is composed of alternating layers of materials of high and low refractive index. Even further improvements are provided, especially in light gain in the corners of the display screen, by combining such an interference filter with an inwardly curved display window, as provided in U.S. Pat. No. 4,683,398, also assigned to U.S. Philips Corporation.

In the process of making these tubes, the interference filter is vapor deposited directly upon the inner curved surface of the faceplate. In order to provide maximum accessibility of this surface to the evaporation source, the face panel, with or without a peripheral sidewall or "skirt", and the funnel portions of the tube envelope are fabricated separately, and are sealed together after evaporation of the filter has been completed.

The luminescent phosphor screen is deposited directly on the interference filter. In theory, this could take place on the open panel before the panel and funnel are sealed together, such as by the slurry or dusting technique used in conventional direct view color tube manufacture, or by a settling technique similar to those used in direct view monochrome television tube manufacture.

However, whereas most direct view phosphor screens can have a few allowable defects in typical ranges from 10 mils to 40 mils in size, projection phosphor screens should be free of all defects in that range and preferably should be free of defects even in the range of 4 to 10 mils. The main reason for this "zero defect" requirement is that the projection display area is magnified, when projected, by a typical factor of about 100 to 1. Defects that look quite small to the eye on a 3"×4" raster become quite large when magnified and projected onto a 30"×40" or larger projection screen.

It is also true that uniform coating density or "screen weight", usually expressed in mg/cm$^2$, is more important for projection tubes then for direct view monochrome. The light output of a given screen at each point is related to the coating density at that point. Since projection tube images are superimposed on one another, notable variations in screen weight from one point to another on the screens would result in poor white field uniformity.

It has been found in practice that screens having zero defects and uniform coating density cannot be produced repeatedly or reliabily on open panels by any of the above techniques. On the other hand, waiting to form the screen until after sealing of the panel to the funnel is not practical for these filter tubes, since access to the panel area for subsequent manufacturing operations needed to complete the tube is then limited to the open neck of the funnel.

OBJECTS AND SUMMARY OF THE INVENTION

Accordingly, it is an object of the invention to provide a method for producing a phosphor screen on a cathode ray tube.

It is another object of the invention to produce a phosphor screen on the face panel of such a tube prior to permanently sealing the face panel to the funnel of the tube.

It is another object of the invention to produce a phosphor screen on the face panel of such a tube using a settling technique.

It is another object of the invention to produce a zero defect phosphor screen on the face panel of such a tube. As used herein, the term "zero defect" means no defects in the range of 10 of 40 mils.

It is another object of the invention to produce a phosphor screen which is of uniform screen weight or coating density.

In accordance with the invention, a phosphor screen is formed on the display panel of a cathode ray tube by temporarily sealing the display panel to a funnel to form a temporary bulb-like envelope, forming the screen on the panel by settling phosphor particles from a liquid suspension contained in the envelope, decanting the liquid, and unsealing the screened panel from the funnel.

This method enables the formation of phosphor screens having zero defects and uniform coating densities, and therefore suitable for use in projection TV tubes without the need for permanently sealing the face panel and funnel together. After the screen has been formed, the temporary envelope may be disassembled, allowing access to the screened face panel for the completion of subsequent manufacturing operations.

According to a preferred embodiment of the invention, the temporarily sealed envelope is formed by placing a gasket between the face panel and funnel, and releasably clamping the assembly together.

BRIEF DESCRIPTION OF THE DRAWINGS

FIG. 1 is a perspective view, partly in section, of a projection television display tube of the invention;

FIG. 2*a* is a diagrammatic cross-section of a portion of the front of the display tube, showing the display window, luminescent screen and interference filter of the invention;

FIG. 2*b* is a detailed cross-section of a portion of the window, screen and filter of FIG. 2*a.

DESCRIPTION OF THE PREFERRED EMBODIMENTS

Figure 3:
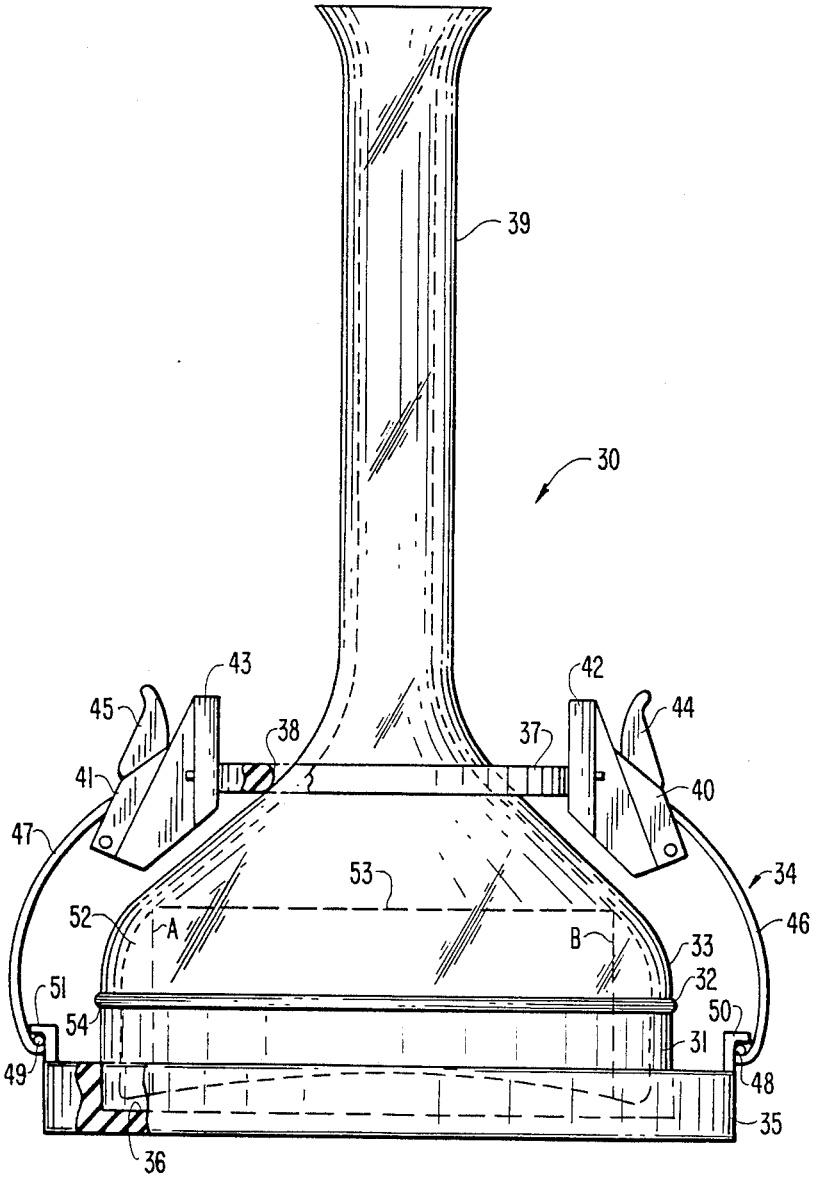
* and FIG. 3 is a side elevation view of a temporarily sealed envelope of a face panel-funnel-gasket assembly and a phosphor settling liquid in the envelope.

FIG. 1 is a perspective view, partly broken away, of a projection television display tube 15 according to the invention. The tube comprises a glass envelope 1 which consists of a display window 2 having an inside inwardly curved surface, a funnel comprising integrated cone 3 and neck 4 portions. Within neck 4 is an electron gun 5 for generating an electron beam 6. The electron beam is focused on a curved display screen 7, provided on the inside of the display window 2 to form a spot 8. The electron beam is deflected over the display screen 7 in two mutually perpendicular directions X, Y, by means of a system of deflection coils 9. Electrical connection to the gun 5 is provided through base 10 with connection pins 11.

FIG. 2*a* is a partial sectional view of the display window 2, having the multi-layer interference filter 12 and the display screen 7 on the inside curved surface. As seen in the more detailed FIG. 2*b*, the display screen 7 consists of a layer of luminescent material (phosphor) 13 and a thin aluminum film 14. The display window is preferably spherical, having a radius of curvature $\phi$.

The details of the filter design are known for example from the teachings of U.S. Pat. Nos. 4,683,398 and 4,634,926 cited above, and are therefore not a necessary part of this description. Briefly, the interference filter comprises alternating layers of low refractive index and high refractive index materials, such as $SiO_2$ and $TiO_2$ having refractive indices of 1.44 and 2.35 respectively, preferred for their hardness and durability. These layers are typically formed by vapor deposition directly on the inner surface of the glass face panel until a total of from 14 to 20 layers have been deposited, increasing numbers of layers resulting in increased definition of the cutoff region of the filter. The average optical thickness of the layers, which is equal to the physical thickness times the index of refraction of the layer, is approximately equal to 0.25 $\lambda f$, where $\lambda f$ is the central wavelength of the filter, which in turn is equal to $p \times \lambda$, where p is an integer having a value between 1.18 and 1.32 and $\lambda$ is the central wavelength of the phosphor.

In addition to a short wave pass (SWP) filter of the type described above, the interference filter may also be in the form of a band pass filter in accordance with the teachings of copending patent application Ser. No. 217,259, filed July 11, 1988, assigned to the assignee of the present application.

In accordance with the invention, phosphor screens having zero defects and uniform screen weight can be formed by settling phosphor particles directly on the face panel of a projection tube by first forming a temporary assembly of the face panel and funnel as shown in a preferred embodiment in FIG. 3. In the Figure, the face panel-funnel assembly 30 comprises face panel 31, gasket 32 and funnel 33, temporarily sealed together by a releasable clamping arrangement 34. The clamping arrangement 34 comprises a face panel holder 35 fabricated, for example, of a hard rubber or plastic material and having an indentation or cavity 36 to receive face panel 31, and collar 37, which may also be fabricated of a hard rubber or plastic material, having a central aperture defined by convex sidewall 38, which fits over the neck portion 39 and rests on the sidewall of the funnel 33. Spring clamps 40 and 41, attached to collar 37 by metal brackets 42 and 43, provide the means for clamping the face panel-gasket-funnel assembly in a releasable manner. This is accomplished by pulling handles 44 and 45 down and away from funnel 33, hooking steel spring elements 46 and 47 around rods 48 and 49 attached to brackets 50 and 51 on holder 35, and then pushing handles 44 and 45 up and in towards the funnel 33 in order to place spring elements 46 and 47 in tension, thereby providing a compressive force between holder 35 and collar 37 to hold the face panel-gasket-funnel assembly securely during subsequent phosphor screen formation.

The gasket inside dimension should coincide with the inside dimension of the seal edge 54 of the panel 31. If the inside dimension of the gasket is smaller, the gasket will extend into the settling solution and particles will settle on the gasket, and might roll off the gasket and onto the screen, creating a defect. On the contrary, if the inside diameter is too large, then there will be a space between the panel seal edge and the funnel where liquid can collect and roll against or drop onto the screen during decantation or afterward.

The screen is formed in a preferred embodiment by pouring a first liquid comprising an electrolyte solution into the envelope formed by the temporary assembly, and then subsequently pouring quickly a second liquid comprising a suspension of phosphor particles into the envelope in a manner to quickly and thoroughly mix the two liquids together to form settling liquid 52 containing even dispersed phosphor particles. The total amount of liquid 52 should be sufficient to achieve a level 53 which upon settling of the phosphor particles from the liquid will result in a screen which is as evenly distributed as possible across the useful area of the face panel surface. Too high a level within the envelope would result in excessive amounts of phosphor particles settling into the central area of the face panel. This uneven distribution results from the fact that the amount of phosphor particles settling in a given area of the face panel is directly proportional to the amount of liquid above that area. The slight convex curvature usually present on the inner face panel surface has a negligible effect on screen uniformity, except when the depth of the settling liquid is small relative to such curvature. In such case, too little phosphor would settle into the central area of the face plate.

Preferably, the level of the liquid is at a height within the envelope such that it projects a vertical column covering approximately 60 to 65 percent of the area of the interior surface of the face panel, indicated by the dotted and dashed projection lines A and B in FIG. 3. This area corresponds to the usable screen area of the projection tube.

A typical composition of the electrolyte solution is 414 ml of barium acetate in demineralized water at a concentration of $4.26 \times 10^{-3}$ moles per liter, while a typical composition of the phosphor suspension is 0.6 grams of phosphor and 78 ml of 7% by weight of silicate solids ($K_2O+SiO_2$) with a mole ratio $SiO_2/K_2O=3.5$ in demineralized water to achieve a total volume of 140 ml. The function of the electrolyte solution is to neutralize the binding charges which maintain the phosphor particles in suspension. Thus, it will be appreciated that upon mixing of the two liquids, settling of the phosphor particles will begin as soon as the agitation resulting from the mixing ceases. Thus, it is critical to the achievement of a phosphor screen of uniform thickness and distribution of particles that the mixing of the two liquids take place as quickly and as completely as possible. It has been found in practice that this can be accomplished in the arrangement shown in FIG. 3 by first placing the electrolyte solution in the envelope and then quickly and completely pouring the phosphor suspension through the center of the neck of the envelope using, for example, an open-ended dispensing funnel, onto the top of the electrolyte solution, in an amount which has sufficient mass and velocity to distribute itself quickly and evenly through the combined volume of liquids. This thorough mixing is aided by the fact that the liquids are contained within the enclosed space defined by the temporary assembly of the panel and the funnel.

In the formation of zero defect screens, the exclusion of foreign particles such as airborne dust is extremely important. Thus, the solutions are filtered to remove all foreign particles larger than 1–1.5 mils in size. Preferably, the dispensing funnel contains a fine-mesh seive in its top section for this purpose. In addition, the panel-funnel assembly is typically thoroughly washed with filtered deionized water prior to settling and the neck opening is covered during settling. Settling typically takes about 15 to 20 minutes for completion, after which the settling liquid is decanted through the neck. The panel-funnel assembly with the phosphor now deposited on the faceplate is then dried, after which the panel-funnel assembly is unsealed, yielding a dried, screened panel and the manufacture of the tube is then completed.

In using the two-liquid phosphor settling technique, as previously stated, the volume of the second liquid must have sufficient mass to provide thorough mixing upon addition of the second liquid into the envelope. For this purpose, and to accommodate phosphors that disperse with difficulty, it has been found that the volume ratio of the two liquids (volume suspension/-volume electrolyte) should be at least 0.28:1, and preferably about 0.34:1.

In order to demonstrate the advantages of the invention, four projection tube flat panels without interference filters were screened by a settling technique in which panel-gasket-funnel assemblies were made from approximately rectangular panels having inside dimensions of approximately $4\frac{1}{8}\times5\frac{1}{8}$ inches and having an intended useful screen area of $3\times4$ inches, matching funnels, and gaskets about 1/16 inch thick and having an inside dimension corresponding to that of the face panel seal edge. 414 mls. of a filtered electrolyte solution containing $1.8\times10^{-3}$ moles per liter of barium acetate was added to the assembly, after which about 140 millileters of a phosphor suspension containing about 0.98 weight percent of potassium silicate solids, as $K_2O$ and $SiO_2$ with a mole ratio of $SiO_2/K_2O$ of 3.44, was added to the electrolyte through an open ended funnel quickly and the phosphor was allowed to settle onto the panel. The phosphor was a blue Zns:Ag having a 50 percent particle size of about 8.6 microns. The screen weight, which resulted after decantation of the liquid and drying of the screen, was about 5.6 milligrams per square centimeter. Visual inspection of the screens showed no defects down to about 2 mils, the limit of the viewer's resolution. In addition, visual inspection showed acceptable screen weight uniformity.

The above procedure was repeated for face panels having curved inner surfaces bearing interference filters except that the concentration of the barium acetate solution was $3.2\times10^{-3}$ moles per liter, and the amount of potassium silicate solids in the phosphor suspension was 0.84 weight percent. The screen weight was about 5.0 milligrams per square centimeter, for a red $Y_2O_3$:Eu phosphor having an average particle size of 7.1 microns; 5.0 milligrams per square centimeter for a blue ZnS:Ag phosphor having an average particle size of 6.1 microns; and about 8.5 milligrams per square centimeter for a green phosphor composed of a mixture of 90 weight percent YAG:Tb and 10 weight percent $ZnSiO_4$:Mn having average particle sizes of 11.6 and 6.8 microns respectively. Again, visual inspection of the screened face panels showed no defects down to about 2 mils. Screen weight uniformity was also acceptable, upon visual inspection of both the screened face panels and of lighted tubes fabricated from these screened face panels.

We claim:

1. A method for producing a luminescent phosphor screen on a display panel of a monochrome cathode ray tube for projection television, the method comprising temporarily sealing the display panel to a funnel to form a temporary bulb-like envelope, forming the screen on the panel by settling phosphor particles from a liquid contained in the envelope, decanting the liquid, and unsealing the screened panel from the funnel.

2. The method of claim 1 in which the temporarily sealed envelope is formed by placing a gasket between the face panel and funnel to form a face panel-gasket-funnel assembly, and releasably clamping the assembly together.

3. The method of claim 2 in which the face panel has a skirt with a seal edge and the inside dimension of the gasket corresponds to the inner dimension of the seal edge.

4. The method of claim 1 in which the liquid is in two parts, the first part comprising an electrolyte solution and the second part comprising a phosphor suspension.

5. The method of claim 4 in which the ratio of volumes of the electrolyte solution and phosphor suspension is at least 0:28:1.

6. The method of claim 4 in which the electrolyte solution is placed in the envelope, and the phosphor suspension is added to the electrolyte.

7. The method of claim 1 in which the inner surface of the face panel is curved.

8. The method of claim 1 in which the inner surface of the face panel has an interference filter, and the screen is formed on the filter.

9. The method of claim 1 in which the level of the liquid is at a height to result in a column of liquid below this level covering about 60 to 65 percent of the area of the interior surface of the display panel.

* * * * *